US010041699B2

(12) United States Patent
Iwama et al.

(10) Patent No.: US 10,041,699 B2
(45) Date of Patent: Aug. 7, 2018

(54) FORCED FLUE HEATER

(71) Applicant: Rinnai Corporation, Aichi (JP)

(72) Inventors: Takahiro Iwama, Aichi (JP); Yoshiaki Kawamura, Aichi (JP)

(73) Assignee: Rinnai Corporation, Aichi (JP)

( * ) Notice: Subject to any disclaimer, the term of this patent is extended or adjusted under 35 U.S.C. 154(b) by 270 days.

(21) Appl. No.: 15/000,073

(22) Filed: Jan. 19, 2016

(65) Prior Publication Data

US 2016/0223224 A1 Aug. 4, 2016

(30) Foreign Application Priority Data

Feb. 4, 2015 (JP) ..... 2015-020717

(51) Int. Cl.
*F24H 3/08* (2006.01)
*F24H 9/18* (2006.01)

(52) U.S. Cl.
CPC ..... *F24H 3/087* (2013.01); *F24H 9/1881* (2013.01)

(58) Field of Classification Search
None
See application file for complete search history.

(56) References Cited

U.S. PATENT DOCUMENTS 675,981 A * 6/1901 Seifert ..... F24C 3/002 126/117
1,004,468 A * 9/1911 Reynolds et al. ..... F25B 9/004 62/403
1,729,202 A * 9/1929 Blomfeldt et al. ..... F24D 5/00 126/110 B
1,837,485 A * 12/1931 Rember ..... F24H 3/087 110/173 B
2,022,835 A * 12/1935 Whiteley ..... F24H 3/087 126/116 A (Continued)

FOREIGN PATENT DOCUMENTS

JP S62-022467 U1 2/1987
JP 2006-183916 A 7/2006

OTHER PUBLICATIONS

Office Action issued in Japanese Application No. 2015-020717, dated Oct. 3, 2017, with English translation (6 pages).

*Primary Examiner* — Gregory Huson
*Assistant Examiner* — Martha Becton
(74) *Attorney, Agent, or Firm* — Nakanishi IP Associates, LLC

(57) ABSTRACT

A forced flue heater draws out combustion gas using a burner fan installed downstream from a heat exchanger to prevent a burner fan motor from being heated to high temperature. The forced flue heater blows air to an air channel using a blower fan, and warms the air using the heat exchanger contained in the air channel. The pressure upstream from the heat exchanger is higher by a value corresponding to the resistance of the heat exchanger. The blower fan contained in an outer case draws in the surrounding air to lower the pressure inside the outer case. A partition separating between the inside and the outside of the air channel has an air outlet located upstream from the heat exchanger. This allows the cool air upstream from the heat exchanger to flow outside the partition. The air is then used as cooling air for cooling the burner fan motor. This structure prevents the burner fan motor from being heated to high temperature when the burner fan is heated to high temperature.

8 Claims, 3 Drawing Sheets

(56) References Cited

U.S. PATENT DOCUMENTS 2,258,790 A * 10/1941 Murphy ..... F24H 3/087 126/110 D
2,268,540 A * 1/1942 Andrews ..... F24H 3/087 126/110 R
2,474,687 A * 6/1949 Parrish ..... F24H 3/087 126/110 R
2,504,315 A * 4/1950 Feuerfile ..... F24H 3/087 126/110 R
2,588,352 A * 3/1952 Budlane ..... B60H 1/2212 126/110 B
3,152,633 A * 10/1964 Morrison ..... F24H 9/1881 126/110 R
3,274,990 A * 9/1966 MacCracken ..... F24C 3/08 126/110 R
3,298,418 A * 1/1967 Briggs ..... F23D 11/00 431/238
3,306,334 A * 2/1967 Goubsky ..... F23D 11/00 126/110 B
3,393,903 A * 7/1968 Berglund, Jr. ..... F24H 3/0488 432/223
4,038,032 A * 7/1977 Brewer ..... F23G 5/50 110/187
4,140,274 A * 2/1979 Nabinger ..... F24H 9/2085 236/11
4,622,005 A * 11/1986 Kuroda ..... F23N 5/123 431/25
4,737,102 A * 4/1988 Jinno ..... F23C 5/02 122/18.4
4,836,182 A * 6/1989 Trowbridge ..... F24H 3/087 126/109
5,433,188 A * 7/1995 Narang ..... F23L 15/04 110/186
6,234,164 B1 * 5/2001 Yasui ..... F23N 5/184 126/110 R
6,795,643 B2 * 9/2004 Ito ..... F24H 3/04 392/307
6,882,796 B2 * 4/2005 Ito ..... F24H 3/04 392/307
8,074,636 B2 * 12/2011 Nishio ..... F24H 3/0488 126/112
8,535,050 B2 * 9/2013 Kuroda ..... F23N 5/242 126/116 A
9,228,759 B2 * 1/2016 Ando ..... G05B 23/0205
9,709,341 B2 * 7/2017 Naruse ..... F28F 9/02
9,746,201 B2 * 8/2017 Miyazaki ..... F24H 1/145
2002/0014233 A1 2/2002 Gatley, Jr.

* cited by examiner

FORCED FLUE HEATER

CROSS-REFERENCE TO RELATED APPLICATIONS

This application claims priority from Japanese Patent Application No. 2015-020717 filed with the Japan Patent Office on Feb. 4, 2015, the entire content of which is hereby incorporated by reference.

BACKGROUND OF INVENTION

Field of the Invention

The present invention relates to a forced flue heater that warms air using a heat exchanger through which combustion gas passes, and blows the warmed air into the room.

Background Art

Warm air heaters that blow warm air from an air outlet have been widely used to heat indoor areas. Such warm air heaters are categorized into one of two types: a heater that mixes combustion gas with air and blows the mixture as warm air into the room, or a heater that discharges combustion gas out of the room after the gas passes through a heat exchanger and warms air drawn from the room using the heat exchanger and blows the warm air (hereafter, a forced flue heater).

A forced flue heater includes a burner, which burns fuel to generate high-temperature combustion gas, a heat exchanger, through which the combustion gas generated by the burner passes, and a blower fan, which draws in air from the room and blows the air toward the heat exchanger. As the blower fan rotates, cool air is drawn in from the room and is blown toward the heat exchanger. The air is warmed by the heat exchanger. The warm air is then blown through a warm air outlet.

The forced flue heater that operates on the above principle is desired to maximize the amount of air that passes through the heat exchanger after blown from the blower fan, and to maximize the amount of air that is blown through the warm air outlet after heated by the heat exchanger. Thus, in many cases, the forced flue heater includes a partition defining an internal air channel, which contains the heat exchanger. The blower fan is installed at one end of the air channel to blow air into the channel. The other end of the air channel is open near the warm air outlet. This structure allows almost all the air that has been blown into the air channel to be warmed by the heat exchanger and to be blown through the warm air outlet.

In this forced flue heater, high-temperature combustion gas generated by the burner passes through the heat exchanger. This heats the heat exchanger to high temperature. If the heat exchanger is heated to an abnormally high temperature for some reason, the heat exchanger may crack. In this case, combustion gas inside the heat exchanger can leak outside through the crack, and may then move together with the flow of air blown by the blower fan and may be blown into the room through the air outlet. A forced flue heater (refer to, for example, Japanese Unexamined Patent Application Publication No. 2006-183916) may include a burner fan installed downstream from a heat exchanger to draw out the combustion gas and draw in fresh air into the burner, instead of a burner fan installed upstream from a burner to force fresh air into the burner. The burner fan installed downstream from the heat exchanger draws out the combustion gas to create negative (vacuum) pressure inside the heat exchanger. In this case, combustion gas inside the heat exchanger does not leak outside if the heat exchanger cracks.

SUMMARY OF INVENTION

In the forced flue heater that draws out combustion gas using the burner fan installed downstream from the heat exchanger, the burner fan is exposed to the combustion gas and is heated to high temperature. The heat is transferred to a burner fan motor that drives the burner fan. The burner fan motor is also heated to high temperature.

One or more aspects of the present invention are directed to a forced flue heater that draws out combustion gas using a burner fan installed downstream from a heat exchanger, without heating a burner fan motor to high temperature.

A forced flue heater according to one aspect of the present invention has the structure described below. The forced flue heater includes an outer case, a blower fan, a heat exchanger, an air channel, a burner, a burner fan, and a burner fan motor. The outer case has an air inlet and a warm air outlet. The blower fan is contained in the outer case. The blower fan is rotatable to draw air into the outer case through the air inlet and blow air warmed by the heat exchanger through the warm air outlet. The air channel includes a partition defining the channel inside the outer case. The air channel contains the heat exchanger. The air channel has a first end that is open toward the blower fan and a second end that is open toward the warm air outlet to guide air blown from the blower fan toward the warm air outlet. Thus, when the blower fun rotates, the pressure inside the air channel becomes higher than the pressure outside the air channel. The burner burns fuel to generate combustion gas and supplies the combustion gas to the heat exchanger. The burner fan draws the combustion gas out of the heat exchanger to draw fresh air into the burner. The burner fan motor is arranged outside the air channel to drive the burner fan. The partition of the air channel includes an air outlet located upstream from the heat exchanger so that a difference in pressure between an inside and an outside of the partition causes air upstream from the heat exchanger to flow through the air outlet as cooling air to cool the burner fan motor.

In the forced flue heater according to the aspect of the present invention, the air blown from the blower fan is warmed by the heat exchanger in the air channel, and then the warmed air is blown through the warm air outlet. The heat exchanger provides resistance to the passage of air flowing inside the air channel. The pressure upstream from the heat exchanger is thus higher by a value corresponding to the air resistance of the heat exchanger. The blower fan is contained in the outer case and draws in the surrounding air to lower the pressure inside the outer case. The partition separating between the inside and the outside of the air channel has an air outlet located upstream from the heat exchanger to allow air upstream from the heat exchanger to flow outside the partition. The air upstream from the heat changer is cold air that is yet to be warmed by the heat exchanger. This air is used as the cooling air to efficiently cool the burner fan motor. This structure prevents the burner fan motor from being heated to high temperature when the burner fan is heated to high temperature.

The forced flue heater may further include a guide channel located outside a portion of the partition including the air outlet. The guide channel guides the cooling air flowing through the air outlet toward the burner fan motor.

This structure can guide the cooling air toward the burner fan motor when the air outlet is distant from the burner fan motor or when the air outlet opens in a direction other than the direction in which the burner fan motor is located and thus the cooling air through the air outlets does not flow in the direction in which the burner fan motor is located. The burner fan motor can be cooled efficiently without limitations by the location of the air outlet or by the direction in which the air outlet is open.

In the forced flue heater according to the aspect of the present invention, the air outlet may be open in a direction to receive air from the blower fan.

This structure uses the flow of air from the blower fan in addition to the pressure difference between the inside and the outside of the partition to allow powerful flowing out of the cooling air. In this case, the burner fan motor can be cooled efficiently with a small amount of cooling air flowing from the air outlet.

Other aspects and advantages of the invention will be apparent upon reading the following description, the drawings, and the claims.

DETAILED DESCRIPTION

Figure 1:
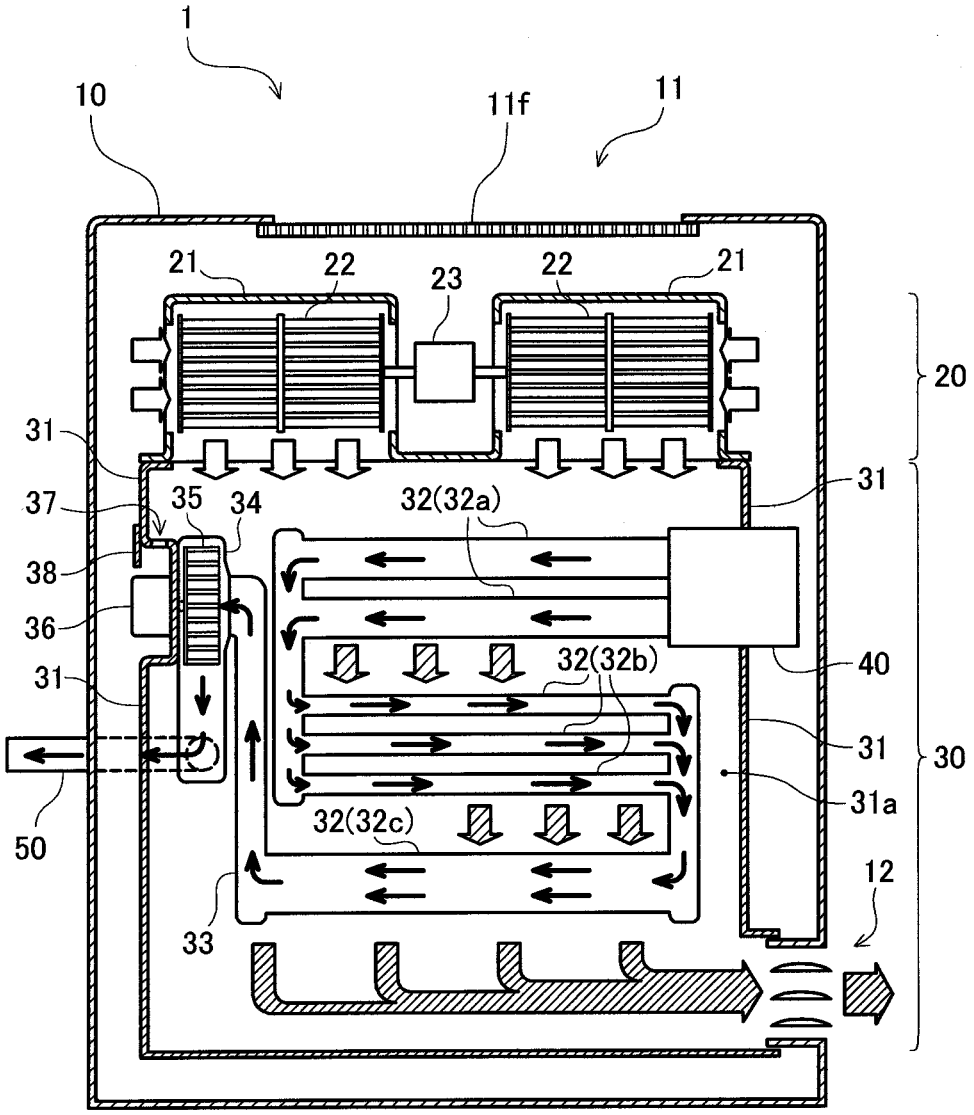
FIG. 1 is a diagram showing the main components of a forced flue heater 1 according to one embodiment.

FIG. 1 is a diagram showing the main components of a forced flue heater 1 according to one embodiment. As shown in the figure, the forced flue heater 1 according to the embodiment includes an outer case 10, which has an air inlet 11 and a warm air outlet 12, a blower unit 20, which draws in air through the air inlet 11 and blows the air toward the warm air outlet 12, and a warm air generation unit 30, which warms the air drawn in by the blower unit 20 through the air inlet 11 to generate warm air.

The blower unit 20 includes blower cases 21, blower fans 22, which rotate inside the corresponding blower cases 21, and a blower fan motor 23, which rotates the blower fans 22. Each blower case 21 has an air outlet (not shown) on its bottom. As the blower fans 22 rotate, the air drawn in from the surrounding environment is blown downward through the air outlets. The white arrows in FIG. 1 indicate the flow of air drawn in by the blower fans 22 from the surrounding environment and then blown downward.

The warm air generation unit 30 includes an air channel 31*a*, which includes a partition 31 defining the channel inside the outer case 10, a heat exchanger 32, which is installed in the air channel 31*a*, a burner 40, which generates combustion gas to flow inside the heat exchanger 32, a burner fan 35, which draws the combustion gas out of the heat exchanger 32, and a burner fan motor 36, which is installed outside the partition 31 and rotates the burner fan 35. The heat exchanger 32 includes an upper heat exchanger 32*a*, into which combustion gas flows initially from the burner 40, an intermediate heat exchanger 32*b*, into which the combustion gas flows after passing through the upper heat exchanger 32*a*, and a lower heat exchanger 32*c*, into which the combustion gas flows after passing through the intermediate heat exchanger 32*b*. The air blown from the blower unit 20 is warmed as the air first passes through the upper heat exchanger 32*a*, the intermediate heat exchanger 32*b*, and then the lower heat exchanger 32*c* in the stated order, and is eventually blown through the warm air outlet 12. The shaded arrows in FIG. 1 indicate the flow of air blown from the blower unit 20, warmed through the heat exchanger 32, and then blown through the warm air outlet 12.

The blower unit 20 draws in air amounting to the air to be blown through the warm air outlet 12, and blows the air toward the air channel 31*a*. To allow all the air blown from the blower unit 20 to flow into the air channel 31*a*, the blower unit 20 is attached at an upstream opening of the air channel 31*a*. The air is drawn by the blower unit 20 through the air inlet 11 into the outer case 10. An air filter 11*f* for removing foreign matter, such as dust, is installed at the air inlet 11. This creates negative pressure inside the outer case 10, which is lower than the outside pressure by a value corresponding to the air resistance of the air filter 11*f*.

A connector channel 33 is connected at the exit of the lower heat exchanger 32*c* included in the heat exchanger 32. Through the connector channel 33, the combustion gas discharged from the lower heat exchanger 32*c* is guided to a burner fan case 34. The connector channel 33 extends in a direction against the air flowing inside the air channel 31*a* (toward the upstream). The burner fan case 34 is thus installed upstream in the air channel 31*a*. The burner fan case 34 contains the burner fan 35 described above, which is rotated by the burner fan motor 36 to draw the combustion gas out of the heat exchanger 32. This creates negative pressure inside the heat exchanger 32. The negative pressure draws fresh air into the burner 40. The burner 40 burns fuel gas using the fresh air drawn in as described above to generate combustion gas. The combustion gas drawn out by the burner fan 35 is eventually discharged outdoors through an exhaust duct 50. The solid arrows in FIG. 1 indicate the flow of the combustion gas generated by the burner 40.

The burner fan 35, which is exposed to the combustion gas, is heated to high temperature. The burner fan motor 36 for rotating the burner fan 35 is also easily heated to high temperature. The forced flue heater 1 according to the present embodiment includes an air outlet 37 in a portion of the partition 31 near the burner fan motor 36. This structure allows cooling air to flow through the air outlet 37, and efficiently cools the burner fan motor 36. Additionally, a guide channel 38 may be located outside the partition 31 to guide the cooling air from the air outlet 37 toward the burner fan motor 36. This further enhances the cooling performance. The mechanism for enabling these will now be described.

Figure 2:
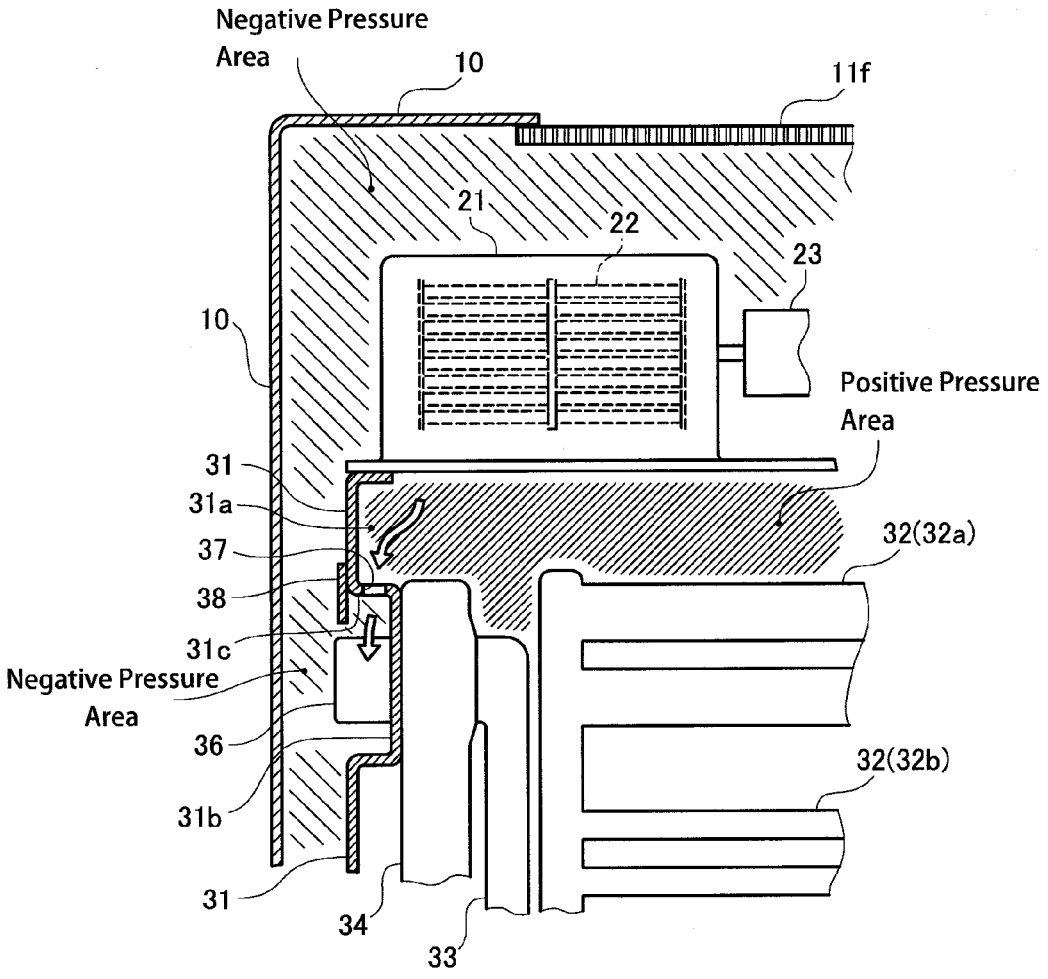
FIG. 2 is a diagram describing a mechanism for efficiently cooling a burner fan motor 36 in the forced flue heater 1 of the embodiment.

FIG. 2 is an enlarged view of an area where the burner fan motor 36 is installed on the partition 31 in the forced flue heater 1 of the present embodiment. As described above with reference to FIG. 1, when the blower fan 22 in the blower case 21 is rotated by the blower fan motor 23, the passage resistance of the air filter 11*f* creates negative pressure inside the outer case 10. The coarsely shaded area in FIG. 2 is a negative pressure area in which negative pressure is created inside the outer case 10.

The air flowing into the air channel 31*a* is heated as it passes through the heat exchanger 32. The air is eventually blown through the warm air outlet 12 of the outer case 10 (refer to FIG. 1). The heat exchanger 32 serves as a resistance to the passage of air flowing in the air channel 31*a*. This creates positive pressure in an area upstream from the heat exchanger 32, which is higher than the pressure (substantially atmosphere pressure) around the warm air outlet 12. In particular, the pressure upstream from the upper heat exchanger 32*a* is particularly high before the air flows against the passage resistance of the upper heat exchanger 32*a*, the intermediate heat exchanger 32*b*, and the lower heat exchanger 32*c* (refer to FIG. 1). The densely shaded area in the air channel 31*a* shown in FIG. 2 is a positive pressure area upstream from the upper heat exchanger 32*a* in which the pressure is a large positive pressure.

Upstream from the upper heat exchanger 32*a*, as clearly shown in FIG. 2, the densely shaded positive pressure area inside the air channel 31*a* and the coarsely shaded negative pressure area outside the air channel 31*a* are separated by the partition 31. The air outlet 37 formed in the partition 31 allows the air upstream from the upper heat exchanger 32*a*, which is yet to be warmed, to flow through the air outlet 37 and to cool the burner fan motor 36. This structure cools the burner fan motor 36 simply by allowing a small amount of air to flow through the air outlet 37. The white arrow in FIG. 2 pointing from the air outlet 37 to the burner fan motor 36 indicates the cooling air that flows through the air outlet 37.

When the cooling air flows through the air outlet 37, the amount of air to be warmed by the heat exchanger 32 decreases accordingly, and the amount of warm air blown through the warm air outlet 12 also decreases accordingly. However, the amount of cooling air flowing through the air outlet 37 is very small relative to the amount of warm air blown through the warm air outlet 12. The amount of warm air blown through the warm air outlet 12 decreases only slightly. Further, the air flows through the air outlet 37 before it is warmed by the heat exchanger 32. Thus, no heat of the combustion gas flowing inside the heat exchanger 32 is lost. Such a decrease in the amount of warm air blown through the warm air outlet 12 does not decrease the quantity of heat contained in the warm air, and does not degrade the heating performance of the forced flue heater 1.

Further, the cooling air flowing through the air outlet 37 circulates back to the negative pressure area inside the outer case 10 after cooling the burner fan motor 36. The cooling air lowers the negative pressure in the negative pressure area. The lower negative pressure inside the outer case 10 causes less load applied to the blower fan 22, which thus blows more air into the air channel 31*a* accordingly. As a result, the use of a portion of the air from the blower fan 22 as cooling air flowing through the air outlet 37 actually causes almost no decrease in the amount of the warm air blown through the warm air outlet 12.

As described above, the forced flue heater 1 according to the present invention includes the partition 31 installed to prevent the air blown from the blower fan 22 from leaking out of the air channel 31*a*, and the partition 31 has the air outlet 37 to allow air to flow through and to cool the burner fan motor 36. This mechanism efficiently cools the burner fan motor 36 without adversely affecting the amount of warm air blown through the warm air outlet 12 or the heating performance of the forced flue heater 1.

As described above with reference to FIG. 1, the forced flue heater 1 according to the present embodiment includes the connector channel 33 that extends in a direction against the air flowing inside the air channel 31*a*. Thus, the combustion gas passing through the connector channel 33 is guided to an upstream position in the flow inside the air channel 31*a*. As a result, the burner fan 35 can be installed at an upstream position in the flow inside the air channel 31*a* (for example, near the upper heat exchanger 32*a*). The burner fan motor 36 can also be installed at an upstream position in the flow inside the air channel 31*a*. This shortens the distance between the air outlet 37 and the burner fan motor 36, and allows the cooling air to flow through the air outlet 37 efficiently toward the burner fan motor 36, and to efficiently cool the burner fan motor 36. In addition, the guide channel 38 outside the air outlet 37 further efficiently guides the cooling air flowing through the air outlet 37 toward the burner fan motor 36. The burner fan motor 36 can thus be cooled more efficiently.

As shown in FIG. 2, the forced flue heater 1 according to the present embodiment further includes a recess 31*b* (toward the air channel 31*a*) in the partition 31 for storing the burner fan motor 36. The air outlet 37 is formed in one side wall 31*c* of the recess 31*b* that is nearer the blower fan 22. The air outlet 37 is open toward the blower fan 22. In other words, the air outlet 37 is open in a direction to receive air blown from the blower fan 22. Thus, a portion of the air blown from the blower fan 22 directly flows through the air outlet 37. The white arrow in FIG. 2 pointing from the blower fan toward the air outlet 37 indicates the flow of the portion of the air blown from the blower fan 22 into the air outlet 37. The forced flu heater 1 with this structure uses the flow of air blown from the blower fan 22 in addition to the pressure difference between the inside and the outside of the partition 31 to increase the speed of the cooling air flowing through the air outlet 37. As a result, the burner fan motor 36 can be efficiently cooled with a small amount of cooling air.

Figure 3:
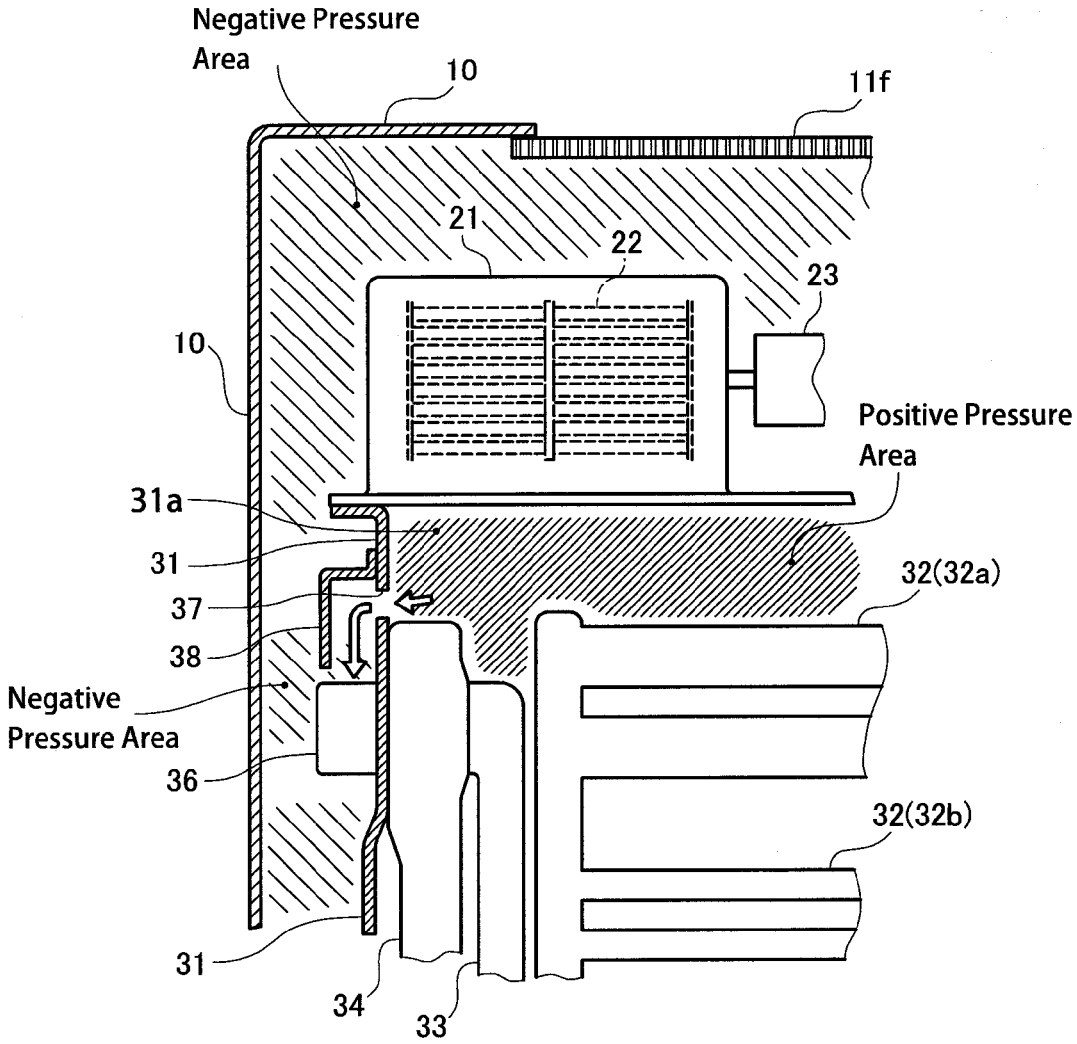
FIG. 3 is a diagram showing a forced flue heater 1 according to a modification.

The forced flue heater 1 of the present embodiment includes the air outlet 37 that is open toward the blower fan 22. In some embodiments, the air outlet 37, which is upstream from the upper heat exchanger 32*a* in the partition 31 separating between the inside and the outside of the air channel 31*a*, may be open in a direction different from the direction toward the blower fan 22. A forced flue heater according to a modification shown in FIG. 3 includes an air outlet 37 that is open in a direction lateral to the flow of air blown from the blower fan 22. The forced fuel heater of this modification also uses the pressure difference between the inside and the outside of the partition 31 to cause cold air (air that is yet to be warmed) upstream from the upper heat exchanger 32*a* to flow through the air outlet 37 as cooling air. The cooling air is then guided by the guide channel 38 toward the burner fan motor 36 to efficiently cool the burner fan motor 36. The structure of this modification allows a higher degree of freedom in designing, for example, the position at which the air outlet 37 is open and the direction in which the air outlet 37 is open, and may thus achieve a more compact and high performance structure of the forced flue heater 1.

Although the embodiments and modifications of the present invention are described, the present invention should not be limited to the above embodiments, and may be implemented in many other embodiments without departing from the spirit and scope of the invention.

REFERENCE SIGNS LIST

1 forced flue heater
10 outer case
11 air inlet
11*f* air filter
12 warm air outlet
20 blower unit
22 blower fan
23 blower fan motor
30 warm air generation unit
31 partition
31*a* air channel

32 heat exchanger
33 connector channel
35 burner fan
36 burner fun motor
37 air outlet
38 guide channel
40 burner

The invention claimed is:

1. A forced flue heater, comprising:

an outer case having an air inlet and a warm air outlet;

a blower fan contained in the outer case, the blower fan being rotatable to draw air into the outer case through the air inlet;

a heat exchanger configured to warm the air drawn in the outer case to allow the blower fan to blow the warmed air through the warm air outlet;

an air channel including a partition defining the channel inside the outer case, the air channel containing the heat exchanger, the air channel having a first end that is open toward the blower fan and a second end that is open toward the warm air outlet to guide air blown from the blower fan toward the warm air outlet;

a burner configured to burn fuel to generate combustion gas and supply the combustion gas to the heat exchanger;

a burner fan configured to draw the combustion gas out of the heat exchanger to draw fresh air into the burner;

a burner fan motor arranged outside the air channel to drive the burner fan; and an air filter disposed at the air inlet and passing air that has flowed into the outer case, wherein the blower fan is disposed at the first end of the air channel and draws air from the outer case into the air channel;

wherein the partition of the air channel includes an air outlet located upstream from the heat exchanger; and wherein actuation of the blower fan generates a difference in pressure between an inside and an outside of the partition, such that the difference in pressure causes air upstream from the heat exchanger to flow through the air outlet to cool the burner fan motor.

2. The forced flue heater according to claim 1, further comprising:

a guide channel located outside a portion of the partition including the air outlet, the guide channel being configured to guide cooling air flowing through the air outlet toward the burner fan motor.

3. The forced flue heater according to claim 2, wherein the air outlet is open in a direction to receive air from the blower fan.

4. The forced flue heater according to claim 1, wherein the air outlet is open in a direction to receive air from the blower fan.

5. The forced flue heater according to claim 1, wherein the heat exchanger comprises an combustion gas inlet through which the combustion gas flows into the heat exchanger, and an combustion gas outlet through which the combustion gas flows out of the heat exchanger;

wherein, in air flow inside the air channel, the combustion gas outlet is disposed at a downstream side of the combustion gas inlet;

wherein, in the air flow inside the air channel, the burner fan is disposed at an upperstream side of the combustion gas outlet;

wherein an connector channel is configured to guide the combustion gas flowing out of the heat exchanger to the burner fan; and wherein the connector channel is configured, such that the combustion gas inside the connector channel flows toward an opposite direction to a direction of the air flow inside the air channel.

6. The forced flue heater according to claim 5, further comprising:

a guide channel located outside a portion of the partition including the air outlet, the guide channel being configured to guide cooling air flowing through the air outlet toward the burner fan motor.

7. The forced flue heater according to claim 5, wherein the air outlet is open in a direction to receive air from the blower fan.

8. The forced flue heater according to claim 6, wherein the air outlet is open in a direction to receive air from the blower fan.

* * * * *